US006155792A

United States Patent [19]

Hartley et al.

[11] Patent Number: 6,155,792

[45] Date of Patent: Dec. 5, 2000

[54] WIRELINE RETRIEVABLE OILWELL PUMPING SYSTEM

[75] Inventors: Alan C. Hartley, Rocky Rapids; Russell S. J. Krasey, Calgary; Norman Obst, Drayton Valley, all of Canada

[73] Assignees: Canadian Occidental Petroleum Ltd.; Option Machine & Repair (1987) Ltd., both of Calgary, Canada

[21] Appl. No.: 09/022,766

[22] Filed: Feb. 12, 1998

[51] Int. Cl.[7] ..... F04B 17/00

[52] U.S. Cl. ..... 417/53; 417/360; 417/390; 417/415; 165/119; 310/87

[58] Field of Search ..... 417/415, 53, 360, 417/390; 165/119; 310/87

[56] References Cited

U.S. PATENT DOCUMENTS

| | | | |
|---|---|---|---|
| 1,799,458 | 4/1931 | Ekstromer . | |
| 2,112,835 | 4/1938 | Ekstromer | 74/57 |
| 2,123,183 | 7/1938 | Ekstromer | 103/46 |
| 2,123,184 | 7/1938 | Ekstromer | 74/57 |
| 4,409,504 | 10/1983 | Wilson et al. | 310/87 |
| 4,417,860 | 11/1983 | Justice | 417/415 |
| 4,878,536 | 11/1989 | Stenlund | 165/119 |
| 4,880,363 | 11/1989 | Holland | 417/390 |
| 5,746,582 | 5/1998 | Patterson | 417/53 |
| 5,871,051 | 2/1999 | Mann | 166/366 |
| 5,954,483 | 9/1999 | Tetzlaff | 417/360 |

*Primary Examiner*—Charles G. Freay
*Assistant Examiner*—Steven Brown
*Attorney, Agent, or Firm*—Townsend & Townsend and Crew, LLP

[57] ABSTRACT

An apparatus for pumping fluids in a wellbore from a subterranean formation. The apparatus includes a tubular housing which is capable of being suspended from its associated upper end in a well bore or hole that communicates with a subterranean formation or oil reservoir. The tubular housing has at least one port or opening where through fluids (e.g. water, oil etc.) pass from the well bore. A pump assembly is contained within the tubular housing such as to be supported thereby. A rotating rod assembly is also contained within the tubular housing and is coupled to the pump assembly for operating the same. A gear assembly is coupled to the rotating rod assembly, and a motor assembly is coupled to the gear assembly while being dependedly attached to the tubular housing. The apparatus additionally includes a filter assembly coupled to the motor assembly.

33 Claims, 13 Drawing Sheets

TRAVELLING BARREL

WIRELINE RETRIEVABLE OILWELL PUMPING SYSTEM

BACKGROUND OF THE INVENTION

1. Field of the Invention

This invention is related to a pumping apparatus. More specifically, the present invention provides for a downhole retrievable apparatus for pumping fluids from an oil reservoir.

2. Description of the Prior Art

A patentability investigation was conducted and the following U.S. Patents, all to E. C. Ekstromer, were discovered: U.S. Pat. No. 1,799,458; U.S. Pat. No. 2,122,835; U.S. Pat. No. 2,123,183; and U.S. Pat. No. 2,123,184.

U.S. Pat. No. 1,799,458 discloses an electrically driven reciprocating pump unit for deep well pumping that can be lowered into the well at the end of the oil discharge pipe and in which there is provided rotary electric motors and means for converting the rotary movement of the motor into a reciprocating movement which can be imparted to a pump sucker rod.

U.S. Pat. No. 2,122,835 discloses a motion converting mechanism embodying jaw clutches adapted to be alternately engaged and disengaged to respectively cause right and left hand nuts to co-act with a feed shaft in actuating a shuttle or other reciprocable member with means for insuring positive and accurate operation of clutches in proper timed relationship to the movements and positions of a reciprocable member.

U.S. Pat. No. 2,123,183 teaches a pumping mechanism wherein a plurality of electric motors are arranged in coaxial relationship to each other and to various other units, including a reciprocating pump, with means for positively maintaining such cooperating relationship of all parts as will prevent any relative displacement thereof both rotatively and axially, so as to insure a properly aligned and balanced condition of the mechanism essential for the latter to function with maximum efficiency.

U.S. Pat. No. 2,123,184 teaches a motion converting mechanism embodying means by which engagement of the jaw clutches is caused to be effected when the jaws of the clutches are relatively at rest rotatively, so as to obviate excessive wear on the teeth of the clutch jaws and sudden stopping of the respective driven member, with the attendant shocks imposed thereon and on associated working parts. U.S. Pat. No. 2,123,184 also teaches a motion converting mechanism wherein frictional braking connections, such as friction brakes, are coordinated with the positive driving connections provided by the jaw clutches, in a manner to smoothly absorb the starting load upon reversal of the shuttle's movement, by causing the jaws of the respective jaw clutch to be brought relatively to rest rotatively, prior to engagement of the jaws, so that such engagement will be smoothly effected and the shuttle then positively actuated.

The foregoing prior art pumping systems, as well as other prior art, are hindered with a high cost and frequency of well servicing. Such prior art pumping systems possess a lot of mechanical wear and tear, especially where rods wear against tubing, and tubing wearing against the casing. Conventional pump jacks have many moving parts. When a pumping oil well needs to be serviced, a workover rig is required which is especially costly.

Therefore, what is needed and what has been invented by us is a pumping apparatus that does not possess the deficiencies associated with the prior art pumping systems and one which eliminates rod failure, tubing holes, pumpjack repairs, and reduces servicing costs.

SUMMARY OF THE INVENTION

The present invention accomplishes its desired objects by providing an apparatus for pumping fluids from a subterranean formation. The apparatus comprises a generally hollow lock body which is capable of being coupled to a tubular housing adapted to be suspended from its upper end in a well hole communicating with a subterranean formation. The lock body has a structure defining at least one lock body port for the outflow of fluids from the subterranean formation. A pump barrel is connected to the lock body and includes a structure defining a plurality of openings for the inflow of fluids from the subterranean formation. A motor assembly is provided and a rotating rod assembly is disposed in the pump barrel. A pump assembly is also disposed in the pump barrel and is coupled to the rotating rod assembly; and a gear assembly is coupled to the rotating rod assembly and to the motor assembly. The apparatus additionally comprises a standing valve assembly connected to the pump barrel. The pump assembly comprises a generally hollow pump plunger having at least one aperture for the inflow of fluids. The pump assembly additionally comprises a plunger back pressure valve supported thereby.

The present invention further accomplishes its desired objects by providing a method for pumping well fluids from a well hole communicating with a subterranean formation comprising the steps of: flowing well fluids through perforations in a tubular housing adapted to be suspended from its upper end in a well hole communicating with a subterranean formation; flowing subsequently the well fluids through perforations in a pump barrel; moving a generally hollow pump plunger in a downwardly direction, causing the well fluids to flow into the generally hollow pump plunger and through a pump back pressure valve; and moving the generally hollow pump plunger in an upwardly direction, causing the well fluids to flow through a generally hollow lock body and into and up the tubular housing. The method additionally comprises flowing the well fluids through a standing valve before flowing the well fluids through the hollow lock body.

The present invention also accomplishes its desired objects by providing an apparatus for pumping fluids from a subterranean formation. The pumping apparatus includes a tubular housing adapted to be suspended from its upper end in a well hole communicating with a subterranean formation. The tubular housing has a structure defining at least one port for the inflow of fluids from the subterranean formation. A pump assembly is disposed in the tubular housing and is supported thereby. The pump assembly includes a pump barrel with perforations to allow the inflow of fluids after the fluids pass through perforations in the tubular housing. A rotating rod assembly is disposed in the pump barrel and is coupled to the pump assembly. The pumping apparatus additionally includes a gear assembly coupled to the rotating rod assembly; and a motor assembly connected to the tubular housing and coupled to the gear assembly.

The pump assembly preferably comprises a pump member coupled to the rotating rod assembly. The pump assembly is preferably seated in the tubular housing in an upside down relationship. The rotating rod assembly preferably comprises a rotating rod member or helix member, and a traveling barrel member encapsulating at least a portion of the rotating rod member. The pump barrel (or rotating rod assembly housing) surrounds the traveling barrel member and the rotating rod.

The motor assembly comprises a motor housing and a stator secured to the motor housing and electrically engaged to an electrical conduit that extends up the well hole outside of the tubular housing. A rotor is rotatably disposed within the stator, and a shaft is connected to the rotor such as to rotate therewith. A support bearing is engaged to the motor housing and supports the shaft.

The gear assembly comprises a tapered gear cone coupling member that is coupled to the rotating rod assembly;

a gear coupling member coupled to the tapered gear cone coupling member; and a tubular head member secured to the tubular housing. The tubular head member has a structure defining an aperture wherethrough fluid may pass. The gear assembly additionally includes a gear bushing supported by the tubular head member for engagedly supporting the shaft.

The pumping apparatus additionally comprises a filter assembly coupled to the motor assembly. The filter assembly comprises a filter housing coupled to the motor assembly; a filter base connected to the filter housing; and a filter member disposed in the filter housing. A heat exchanger member is supported by the filter housing. The filter base has a structure defining a vent opening which is capable of being plugged; and a plug pipe is secured to the filter base.

The rotating rod assembly additionally comprises at least one bushing member secured to the rotating rod assembly housing and engaged to the tubular housing to prevent undesirable particulates from entering into contact with the rotating rod member. The rotating rod assembly housing (or pump barrel) has a structure defining at least one bearing aperture; and at least one rod assembly bearing is disposed in the at least one bearing aperture to keep the traveling barrel from rotating. The rotating rod member or helix member has a structure defining a plurality of helix tracks or grooves. A plurality of traveling barrel bearings is engaged to the traveling barrel and is disposed in the plurality of helix tracks. A tapered bushing member is connected to the rotating rod member.

The pumping apparatus additionally comprises a generally hollow mechanical lock assembly disposed in the tubular housing and having at least one opening wherethrough fluids pass into the tubular housing. The hollow lock body has a latching member secured thereto. A pump seating nipple is secured to the tubular housing; and a pump shoulder member is secured to the standing valve assembly and is supported by the pump seating nipple.

It is therefore an object of the present invention to provide an apparatus for pumping fluids from a subterranean formation.

It is another object of the present invention to provide a method for pumping well fluids from a well hole communicating with a subterranean formation.

Other objects of the present invention will become obvious to the artisans possessing the ordinary skill in the art.

These, together with the various ancillary objects and features which will become apparent to those skilled in the art as the following description proceeds, are attained by this novel wireline retrievable oilwell pumping system and method, a preferred embodiment being shown with reference to the accompanying drawings, by way of example only, wherein:

DESCRIPTION OF THE PREFERRED EMBODIMENT

Figure 1:
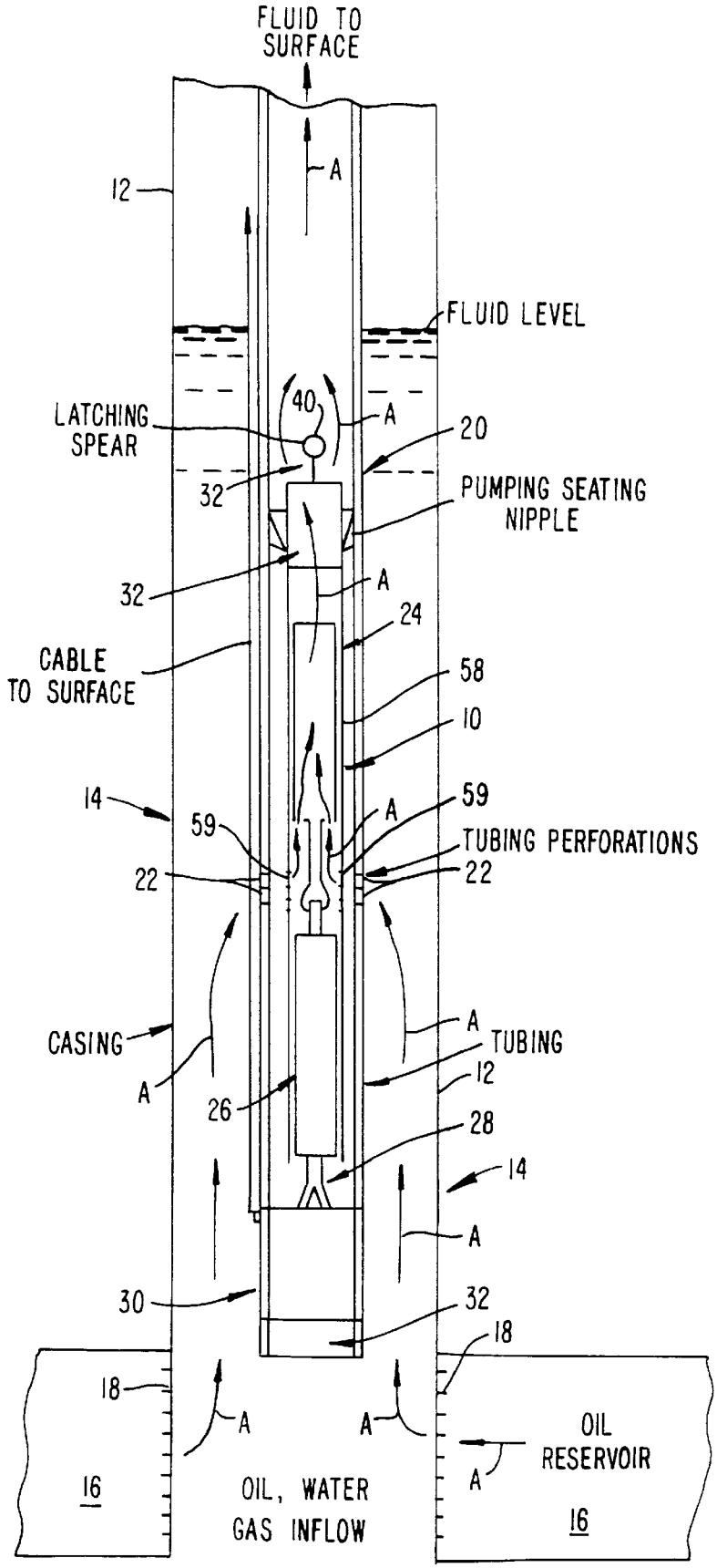
FIG. 1 is a schematic drawing of the pumping apparatus of the present invention disposed in a wellbore communicating with an oil reservoir.
Figure 2:
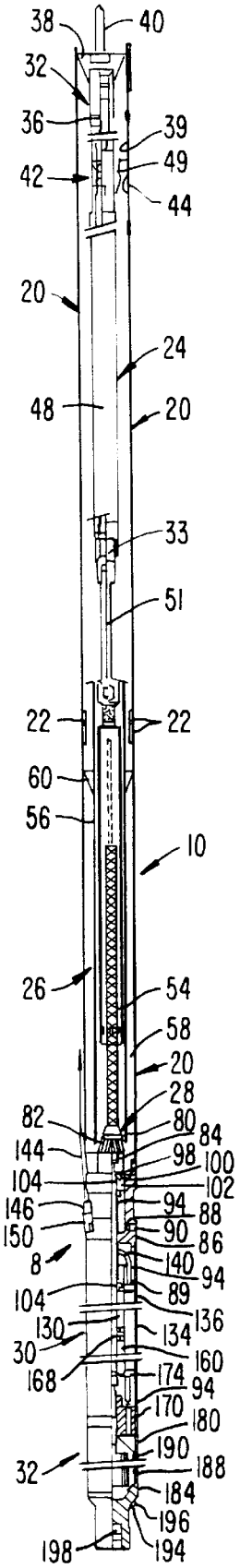
FIG. 2 is a vertical sectional view of the pumping apparatus of the present invention.
Figure 3:
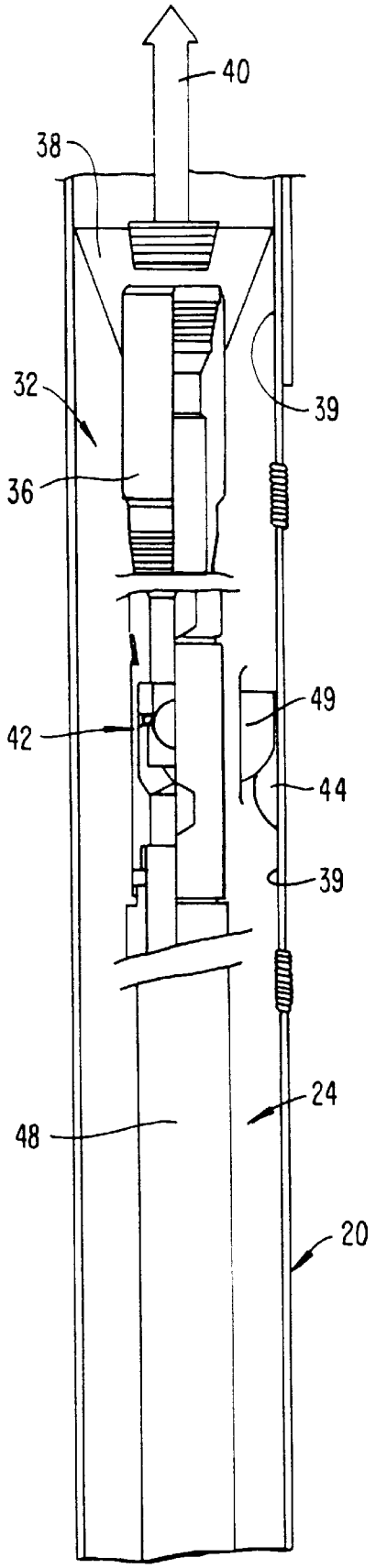
FIG. 3 is an enlarged vertical sectional view of the top or upper section of the pumping apparatus of the present invention, disclosing and illustrating the mechanical top lock, the pump seating nipple and a portion of the pump member.

Referring in detail now to the drawings wherein similar parts of the invention are identified by like reference numerals, there is seen the pumping apparatus of the present invention, generally represented as 10. As best shown in FIG. 1, the pumping apparatus 10 extends down into casing 12 of a well bore, generally illustrated as 14. The pumping apparatus 10 is coupled to a production tubing 20 which has at least one port or opening 22, preferably a plurality of ports or openings 22, wherethrough the oil, water and gas inflow flows or passes. The casing 12 conveniently communicates with an oil reservoir 16 through perforations 18 within the casing 12. Oil, water and gas inflow pass from the oil reservoir 16, through perforations 18 and into the casing 12. From within the casing 12, the oil, water and gas inflow flows through ports 22 of the tubular housing 20 and into the pumping apparatus 10 in a manner described below in order to be pumped to the surface of the earth.

Figure 7:
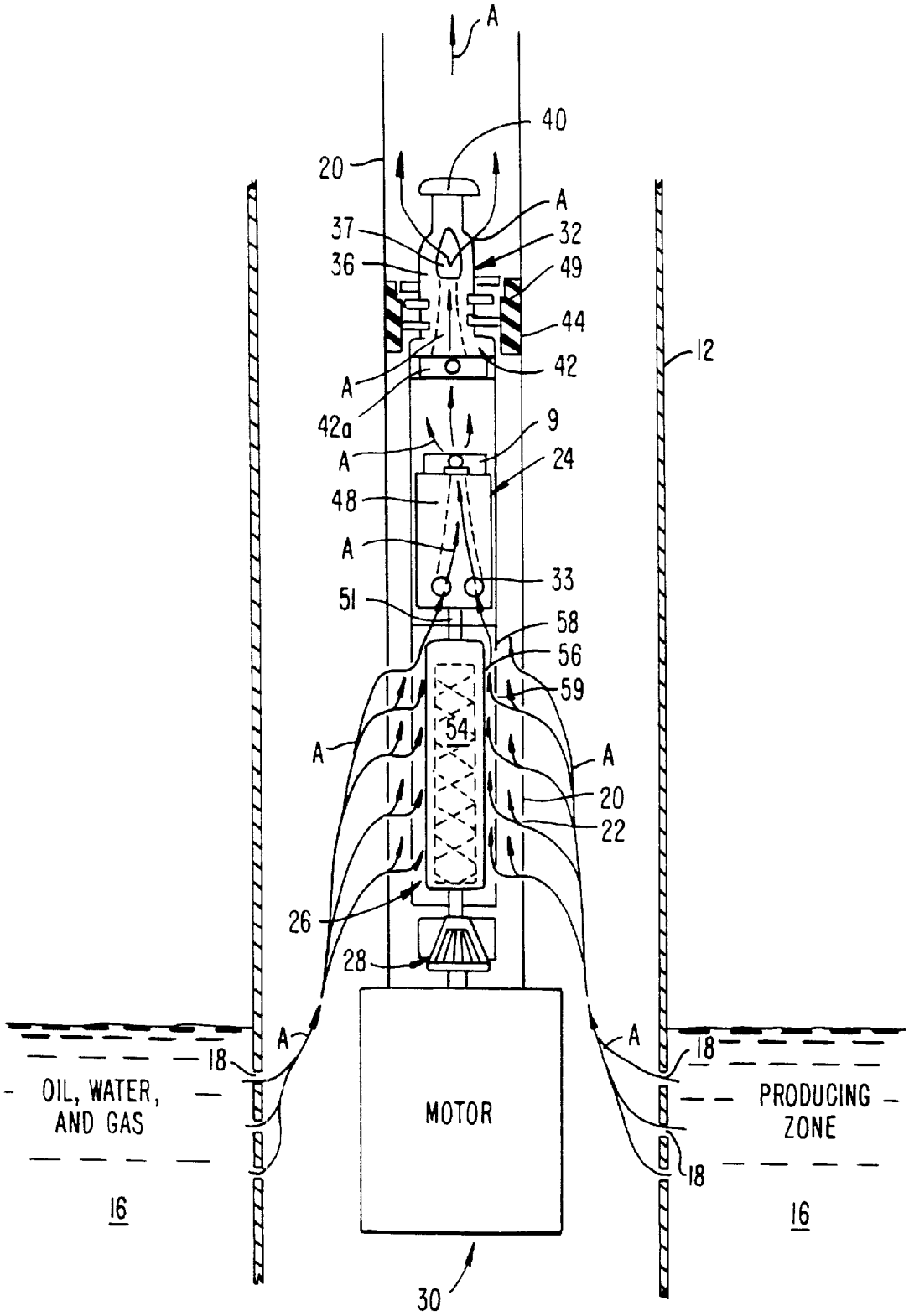
FIG. 7 is a partial schematic vertical sectional view illustrating the pump near a down stroke position and the passing of fluid from the oil reservoir, through casing perforations, through ports of a tubular housing, through perforations in the pump barrel, through plunger apertures and into the plunger, through the plunger back pressure valve (travelling valve & cage) and into the space between the plunger back pressure valve and the pump barrel back pressure valve (standing valve & cage), through the pump barrel back pressure valve and into the generally hollow mechanical lock body, and through ports in the mechanical lock body and into the production tubing.
Figure 8:
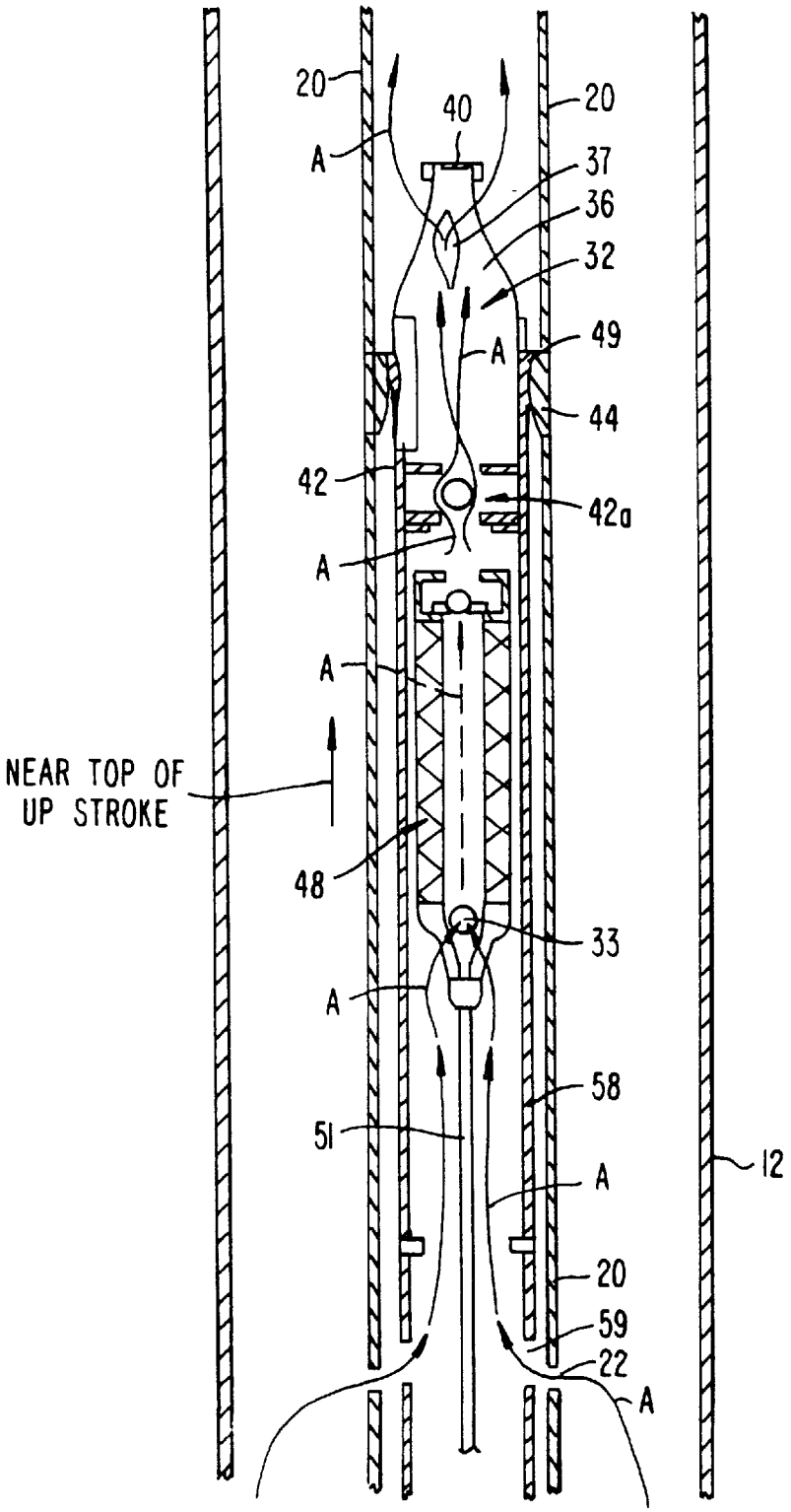
FIG. 8 is a partial schematic vertical sectional view illustrating the pump near an up stroke position and the passing of fluid through perforations in the pump barrel, through plunger apertures and into the plunger, through the plunger back pressure valve (traveling valve & cage) and into the space between the plunger back pressure valve and the pump barrel back pressure valve (standing valve & cage), through the pump barrel back pressure valve and into the generally hollow mechanical lock body, and through ports in the mechanical lock body and into the production tubing.

In a preferred embodiment for the pumping apparatus 10, the pumping apparatus 10 connects to the tubular housing 20 which is capable of and adaptable for being suspended from an associated upper end (not shown) in the well bore 14 that pierces and communicates with the oil reservoir 16. As best shown by arrows A in FIGS. 1 and 7 and 8, oil, water and gas inflow passes from the oil reservoir 16, through perforations 18 of casing 12, through ports 22 of the production tubing 20 and into the pumping apparatus 10, more specifically into a pump assembly (identified as "24" below) of the pumping apparatus 10. As previously indicated and as further shown by the arrows A illustrated as following the flow of fluids in the pumping operation of the pumping apparatus 10, the pumping apparatus 10 pumps or transfers the oil, water and gas inflow up the production tubing 20 to the surface of the earth.

The pumping apparatus 10 also includes a pump assembly, generally illustrated as 24 and disposed in the tubular housing 20 such as to be supported thereby. A rotating rod assembly, generally illustrated as 26, is also disposed in the tubular housing 20 and is coupled to the pump assembly 24. A gear assembly, generally illustrated as 28, is coupled to the rotating rod assembly 26. The pumping apparatus 10 also comprises a motor assembly and a filter assembly, generally illustrated as 28 and 30, respectively. The motor assembly 28 is connected to the tubular housing 20 and is coupled to the gear assembly 28. The filter assembly 30 is coupled to motor assembly 28 such as to communicate therewith.

The pumping apparatus 10 also includes a mechanical lock assembly, generally illustrated as 32. As best shown in FIGS. 2, 3, 7 and 8, the mechanical lock assembly 32 comprises a generally hollow mechanical lock body 36. The hollow lock body 36 has at least one opening 37 wherethrough fluids outflow into the production tubing 20. A spear support 38 connects to the mechanical lock body 36 and flushes against an inside cylindrical surface 39 of the tubular housing 20. A latching-on spear 40 (i.e. a latching member) connects to the spear support 38 to provide a means where the pumping apparatus 10 may be connected to a wire line (not shown) to be lowered into the casing 12 of the well bore 14. The inside cylindrical surface 39 of the tubular housing 20 also supports a pump seating nipple 44 that is bound thereto.

The pump assembly 24 for the pumping apparatus 10 may be any suitable pump assembly that is capable of providing the required pumping function for the pump assembly 24. In a preferred embodiment of the invention, the pump assembly 24 comprises a pump shoulder member 49 bound to a standing valve assembly 42 which is coupled to the lock assembly 32 via a pump barrel 58. The pump assembly 24 includes a generally hollow pump plunger 48 with a plurality of apertures 33 where fluids flow through (see FIG. 8). The hollow pump plunger 48 is supported by a rod 51 which is coupled to the rotating rod assembly 26, more specifically to a travelling barrel (identified as "56" below). The hollow pump plunger 48 supports a pump back pressure valve 9. The standing valve assembly 42 includes a back pressure valve 42*a* where fluids flow through from the generally hollow pump plunger 48. Well fluids pass through the ports 22 in the tubing 20, through the openings 59 in the pump barrel 58, through the apertures 33 (see FIGS. 7 and 8) in the hollow pump plunger 48, through the back pressure valve 9 supported by the hollow pump plunger 48, through the back pressure valve 42*a* of the standing valve assembly 42 and into the generally hollow lock body 36, and through the opening 37 of the hollow lock body 36 and into the tubing 20 (see arrows A in FIGS. 1, 7 and 8).

Figure 4:
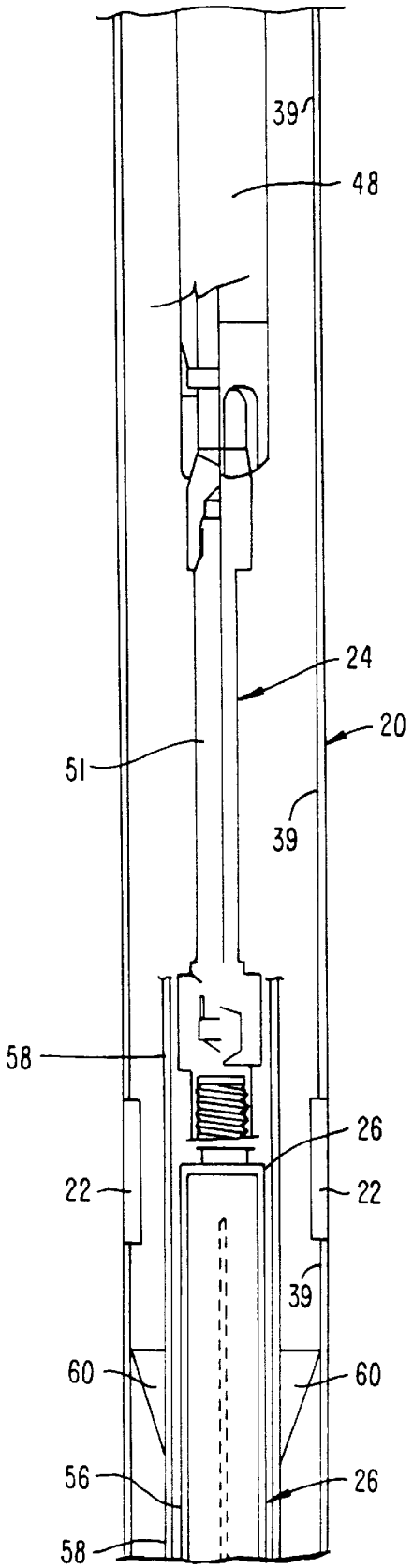
FIG. 4 is an enlarged vertical sectional view of a central section of the pumping apparatus, disclosing and illustrating a portion of the pump member, and a portion of the connecting rod assembly coupled to the pump member.
Figure 5:
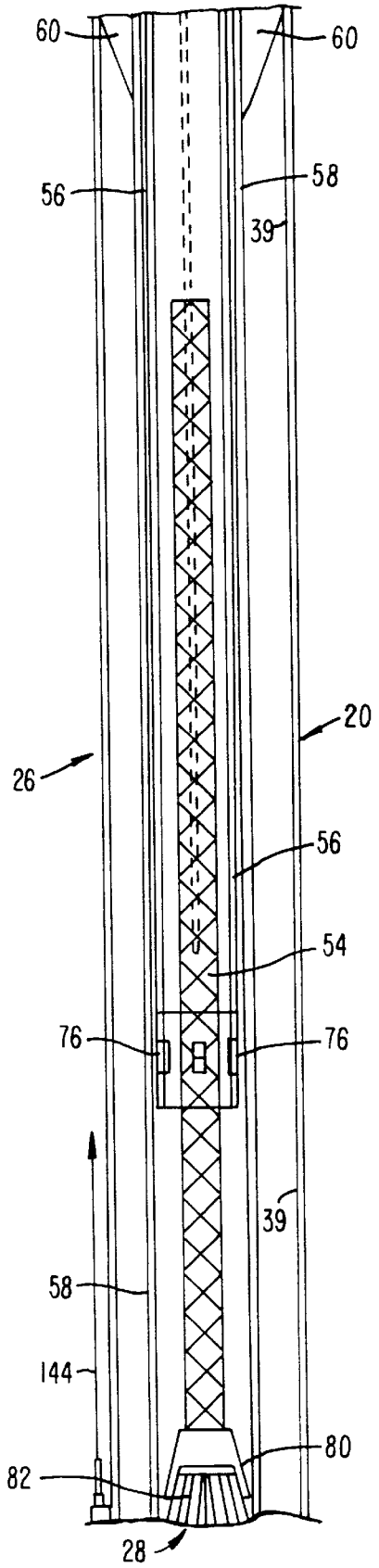
FIG. 5 is an exploded view of a central section of the pumping apparatus disclosing and illustrating the connecting rod assembly and a portion of the gear assembly.

The rotating rod assembly 26 consist of a rotating rod member 54 (see FIGS. 4 and 5) and a traveling barrel 56 encapsulating at least a portion of the rotating rod member 54. A rotating rod assembly housing (i.e. the pump barrel) 58 surrounds the traveling barrel 56 and the rotating rod 54. The rotating rod assembly housing or pump barrel 58 has a plurality of openings 59 wherethrough fluids pass after passing through the ports 22 in the tubular housing 20, and at least one bushing member 60 (preferably two or more bushing members 60) secured thereto. The bushing members 60 flush against the inside cylindrical surface 39 of the tubular housing 20 such as to enable the tubular housing 20 to support the rotating rod assembly housing or pump barrel 58. The bushing members 60 also function to prevent undesirable particulates from entering into contact with the rotating rod 54.

Figure 9:
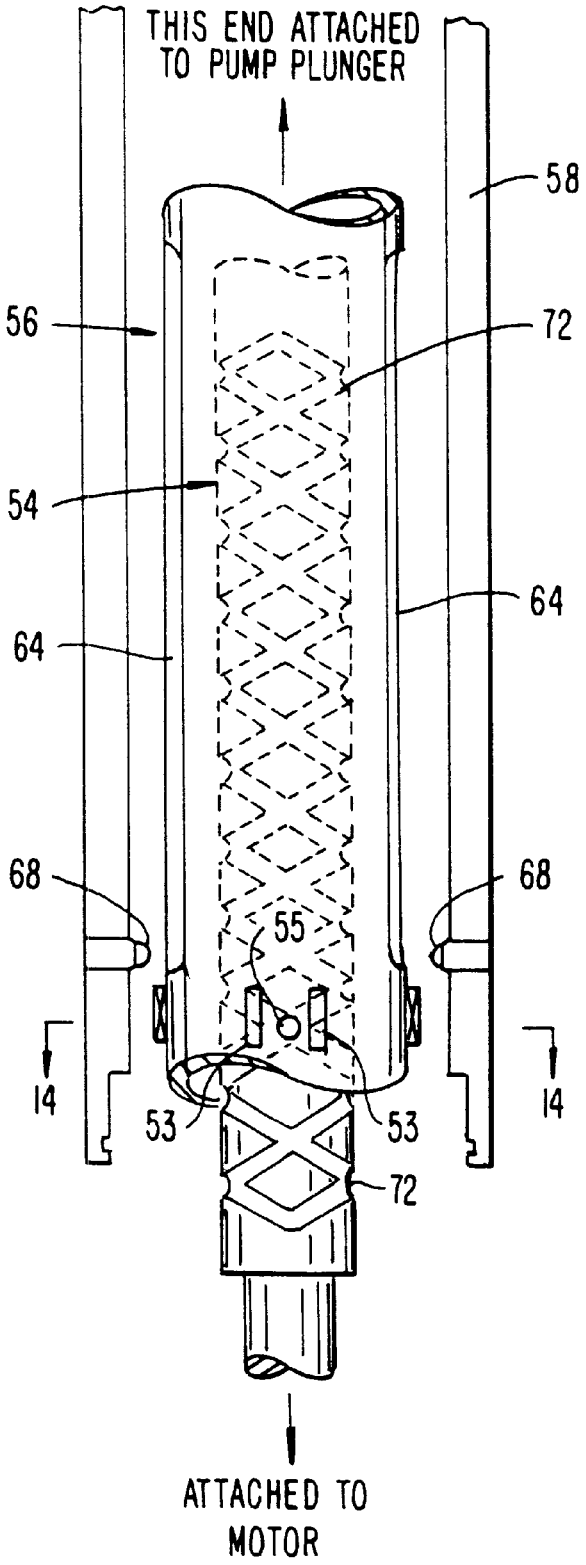
FIG. 9 is a partial vertical section view illustrating the pump barrel, a traveling barrel generally concentrically disposed with respect to the pump barrel for connecting to a rod of the pump assembly, and a helix member generally concentrically disposed in the traveling barrel and coupled to the traveling barrel such that as the helix member is rotated by the motor, the traveling barrel reciprocates upwardly and downwardly by traveling ball bearings lodging within helical shaped grooves in the helix member.
Figure 10:
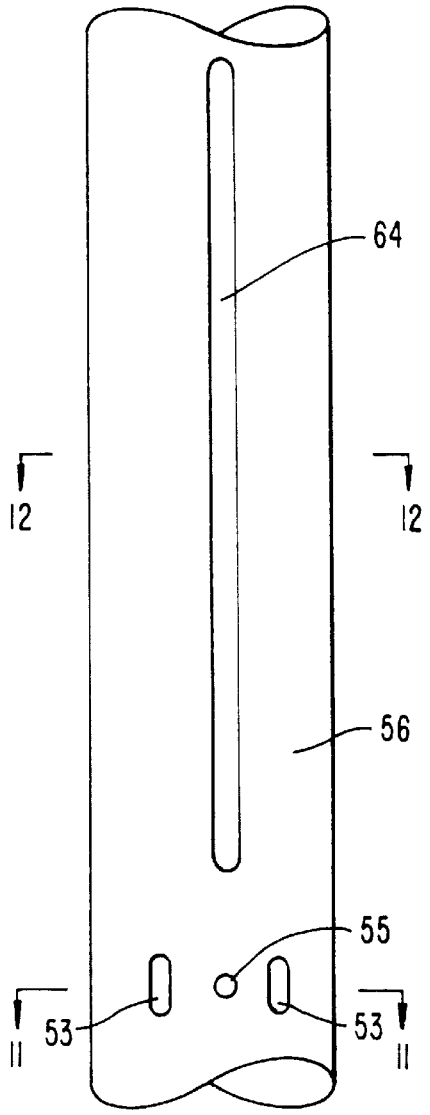
FIG. 10 is an elevational view of the traveling barrel showing a longitudinal groove where a fixed ball bearing lodges to prevent the traveling barrel from rotating and a plurality of openings wherein traveling ball bearings lodge for engaging the helical grooves of the helix member.
Figure 12:
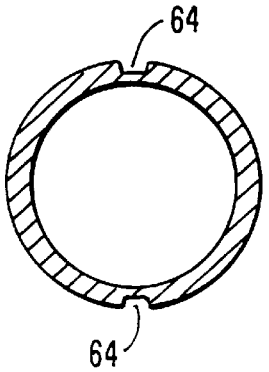
FIG. 12 is a horizontal sectional view taken in direction of the arrows and along the plane of line 12—12 in FIG. 10.
Figure 13:
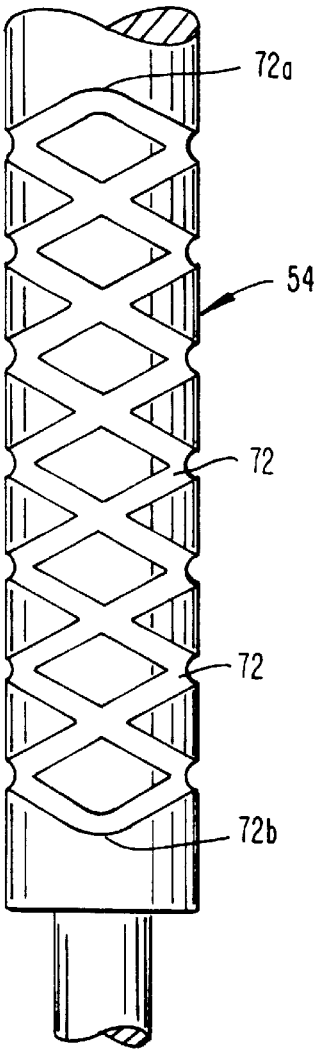
FIG. 13 is an elevational view of the helix member.

The rotating rod assembly housing or pump barrel 58 has at least one longitudinal groove 64 (see FIGS. 10 and 12) that rotatably houses at least one bearing 68 which is supported by the pump barrel 58 (see FIG. 9) such that the traveling barrel 56 does not rotate when the rotating rod 54 is rotated by the motor assembly 58. As best shown in FIG. 13, the rotating rod 54 has a plurality of helix tracks 72 wherein a plurality of traveling barrel bearings 76 lodge and engage the traveling barrel 56. The rotating rod 54 is machined with double start right and left grooves or tracks 72 to accommodate the traveling spherical ball bearings 76. The pump barrel 58 has openings 53 to house the traveling ball bearings 76. The pump barrel 58 also has openings 55 to house a stationary ball bearing 57 (see FIGS. 9–14). A tapered conical shaped bushing 80 is connected to the rotating rod 54.

Figure 11:
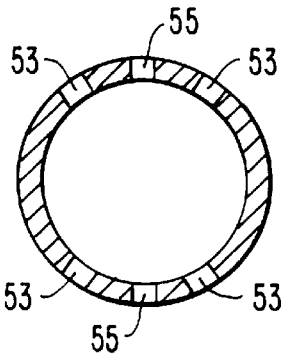
FIG. 11 is a horizontal sectional view taken in direction of the arrows and along the plane of line 11—11 in FIG. 10.
Figure 14:
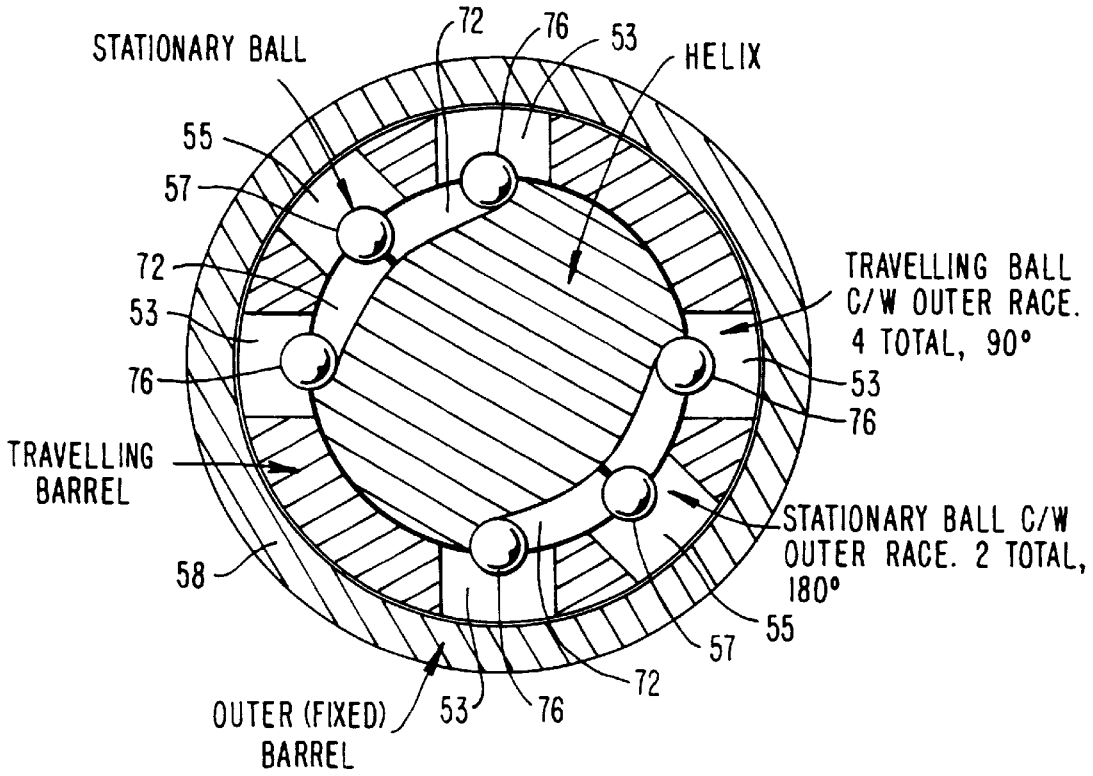
FIG. 14 is a horizontal sectional view taken in direction of the arrows and along the plane of line 14—14 in FIG. 9.

As best shown in FIGS. 11 and 14, traveling ball bearings 76 lodge in helix (or helical) tracks 72 such that when the rotating rod 54 is rotated, the ball bearings 76 travel in the tracks 72, causing the traveling barrel 56 to move either up or down. When the travelling barrel 56 moves, the connecting rod 51 moves therewith, causing the hollow pump plunger 48 to also move. The tracks 72 have an upper track 72*a* extremity and a lower track 72*b* extremity. When ball bearings reach either one of the track extremities (i.e. either upper or lower track extremity 72*a* or 72*b*), the ball bearings 76 reverse direction of travel with respect to their movement along the rotating rod member 54. Thus, if ball bearings 76 are traveling in a track 72 which causes them to travel towards upper track 72*a* extremity, the traveling barrel 56 is moving towards upper track 72*a* extremity or upwardly toward the standing valve assembly 42. When the ball bearings 76 reach upper track 72*a* extremity, the ball bearings 76 reverse the direction of travel and move into a track 72 that causes them to travel towards lower track 72*b* extremity, which simultaneously causes the traveling barrel 58 to reverse its direction of travel and move downwardly.

Figure 15:
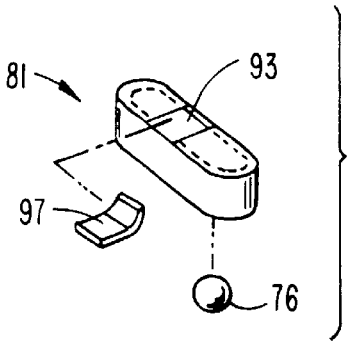
FIG. 15 is a segmented perspective view of the clip or bearing housing which retains one of the traveling ball bearings and lodges in one of the openings in the traveling barrel such that the retained ball bearings is capable of protruding inwardly for lodging within a helical groove of the helix member.
Figure 16:
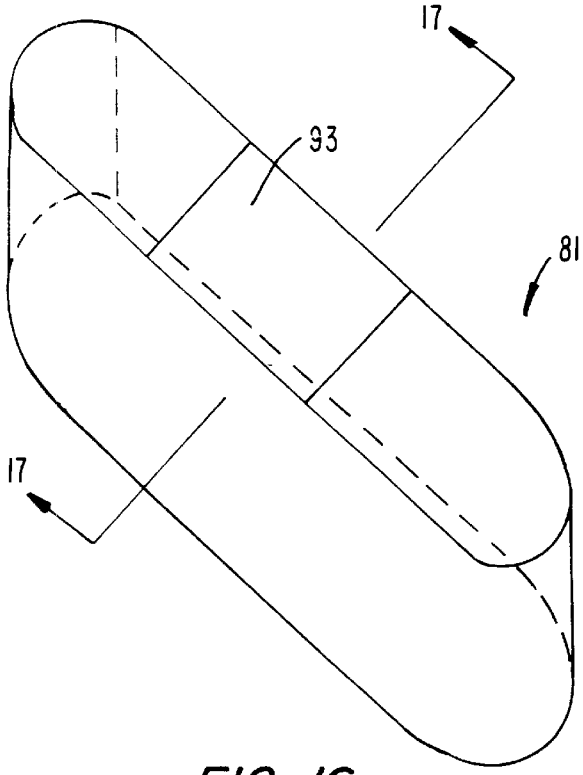
FIG. 16 is a perspective view of the clip or housing of FIG. 15.
Figure 17:
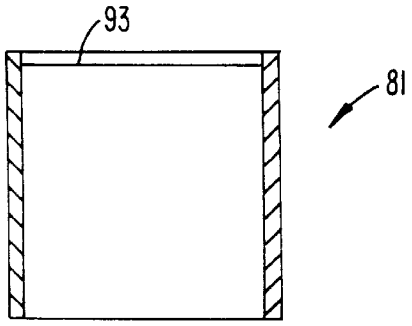
FIG. 17 is a vertical sectional view taken in direction of the arrows and along the plane of line 17—17 in FIG. 16.
Figure 18:
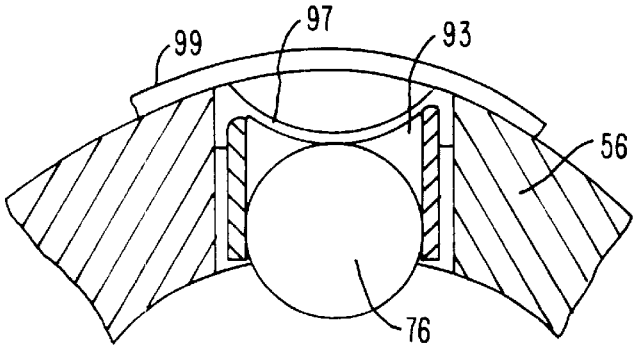
FIG. 18 is a partial vertical sectional view of the housing of FIG. 15 lodged in one of the openings of the traveling barrel with a spring member retaining a ball bearing therein such that, the ball bearing is capable of protruding inwardly for engaging a helical track of the helix member and with a bearing keeper ring circumscribing the traveling barrel to retain the bearing housing and the spring member within the opening of the traveling barrel.

The traveling ball bearings 76 and stationary ball bearing 57 may be retained in the openings 53 and opening 55 respectively in any suitable manner. By way of example only and as best shown in FIGS. 15–18, a bearing housing, generally illustrated as 81, may be provided to releasably lodge in an opening 53 to position a traveling ball bearing 76 therein. More specifically, FIG. 15 is a segmented perspective view of the bearing housing 81 which retains one of the traveling ball bearings 76 and lodges in one of the openings 53 in the traveling barrel 56 such that the retained ball bearings 76 is capable of protruding inwardly for lodging within a helical track 72 of the helix or rotating rod member 54. FIG. 16 is a perspective view of the housing 81 of FIG. 15 and disclosing an opening 93. A spring member 97 clips releasably within opening 93 to retain the traveling ball bearing 76. Referring now to FIG. 18, there is seen a partial vertical sectional view of the housing 81 of FIG. 15 lodged in one of the openings 53 of the traveling barrel 56 with the spring member 97 retaining the ball bearing 76 therein such that the ball bearing 76 is capable of protruding inwardly for engaging a helical track 72 of the helix or rotating rod member 54 and with a bearing keeper ring 99 circumscribing the traveling barrel 56 to retain the bearing housing 81 and the spring member 97 within the opening 53 of the traveling barrel 56.

Figure 6:
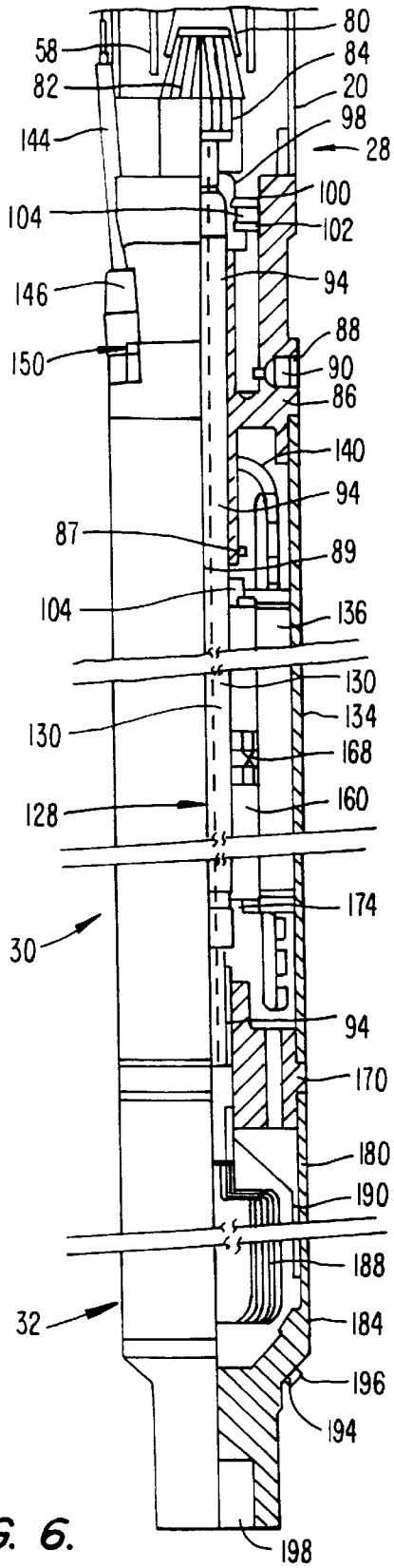
FIG. 6 is an exploded view of the bottom or lower section of the pumping apparatus disclosing and illustrating the gear assembly, the motor assembly engaged to the gear assembly, and the filter assembly engaged to the motor assembly.

The gear assembly 28 (see FIG. 6) includes a tapered gear cone coupling member 82 that is coupled to the rotating rod assembly 26, more specifically to the tapered conical shaped bushing 80. A gear coupling member 84 is coupled to the tapered gear cone coupling member 82. The gear assembly 28 also includes a tubular head member 86 secured to the tubular housing 20. The tubular head member 86 is provided with a guard (lead) 87 and with an aperture 88 wherethrough fluid is permitted to pass after removal of a plug 90 disposed in said aperture 88. The gear assembly 28 also has a bushing 94 supported by the tubular head member 86 for engagedly supporting a shaft (identified below as "130") of a motor (identified below as "128"). A washer (upthrust) 89 is disposed contiguous and against the bushing 94 The gear assembly 28 further has a ring retainer 98 to retain a two piece ring 100 and a bearing thrust 102 and a runner-thrust 104.

The motor assembly 30 comprises a motor 128 with a (motor) shaft 130, and a motor housing 134. A stator 136 is secured to the motor housing 134 and is electrically engaged to an electrical conduit 140 that engages a cable 144 which extends up the well bore 14 outside of the tubular housing 20. The cable 144 is provided with a flange 146 that couples to the cable 144 through a capscrew/lock wash combination, generally illustrated as 150. A rotor 160 is rotatably disposed within the stator 136 and is coupled to the shaft 130 such that the shaft 130 may turn with the rotor 160. The rotor 160 is furnished with a rotor compression nut 164. The motor assembly 30 also includes a bearing support 170 and a two piece ring 174. The bearing support 170 is engaged to the motor housing 134 and supports the shaft 130.

The filter assembly 30 consists of a filter housing 180 coupled to the motor assembly 28, more specifically to the motor housing 134 of the motor assembly 28. A filter base 184 is coupled to the filter housing 180. The filter assembly 30 also comprises a filter member 188 (i.e. a bag filter) and a heat exchanger 190, both positioned in the filter housing 180. The filter base 184 has a vent opening 194 that is typically plugged by a plug 196. A plug pipe 198 is secured to the filter base 184. The filter assembly 30 may be a perforated joint of tubing (not shown).

In operation of the invention, the rotating rod assembly 26 works with a worm screw (i.e. the rotating rod or helix member 54) and the bearings 76 which convert the rotary motion of the motor 128 to linear motion which is used to power the pump plunger 48. The linear stroke length would be in the 2 ft. to 6 ft. range depending on the distance between upper track 72*a* extremity and lower track 7*ab* extremity on the rotating rod/helix 54, and further depending on the volume of fluid which needs to be lifted.

Once the fluid (oil, water and gas) has passed through the openings 22 in the tubing 20, the fluid passes through the openings 59 in the pump barrel 58, through the apertures 33 in the hollow pump plunger 48 and through the back pressure valve 9 on the down stroke. On the up stroke of the pump plunger 48, compression of the fluid trapped between the back pressure valve 9 and back pressure valve 42*a* of the standing valve assembly 42 takes place. When the compressed fluid exceeds the hydrostatic pressure exerted by the fluid in the tubing 20 above the standing valve assembly 42, the standing valve assembly 42 (i.e. the back pressure valve 42*a*) opens and the volume that is being displaced by the pump plunger 48 is gathered at the surface either by a pipe or a tank. The length of the stroke of would depend on the distance between upper track 72*a* extremity and the lower track 72*b* extremity of the rotating rod/helix 54.

Permanently connected to the coupling or rotating rod assembly 26 is the modified API insert pump plunger 48. The pump plunger 48 is run upside down. The fluid flows into the pump plunger 48 via apertures 33 and is pumped into the tubing or tubular housing 20 as previously indicated above. At the top of the lock assembly 32 there is a wireline latching spear 40. When servicing is required, due to pump failure, the pump system can be retrieved from the well using a braided wireline unit and a lubricator on surface. No service rig would be required to pull the pump system. When the motor 128 needs to be repaired, the tubing string would have to be pulled by a service rig. The useful life of an electric motor is usually longer than five years.

The following changes and improvements over current oilwell pumping systems are provided by the pumping apparatus 10 of the present invention: (1) pumpjack and rods are eliminated; (2) pumpjack repairs are eliminated; (3) tubing repairs are greatly reduced; (4) the pump and coupling can be retrieved by wireline which greatly reduces cost; (5) the pump is run in upside down; (6) new well installation costs are reduced; (7) the electric motor is installed with a pressure sensor which allows the well to be placed on automatic and be pumped within certain fluid level parameters that would maximize production and reduce electrical consumption; (8) wells could be worked over in less time; and (9) wells would not have to be killed with fluid which would reduce recovery time and increase production volumes.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

What is claimed is:

1. An apparatus for pumping fluids from a subterranean formation comprising:

(a) a tubular housing adapted to be suspended from its upper end in a casing within a well hole communication with a subterranean formation; said tubular housing having a structure defining at least one port for the inflow of fluids from the subterranean formation;

(b) a pump assembly disposed in said tubular housing and comprising a generally hollow reciprocating pump plunger having pump-plunger apetures;

(c) a rotating assembly disposed in said tubular housing and comprising a rotating rod member, a traveling barrel member encapsulating at least a portion of said rotating rod member, and coupled to the generally hollow reciprocating pump plunger for moving the same, and a rotating rod assembly housing surrounding said generally hollow reciprocating pump plunger, said traveling barrel member and said rotating rod and being supported by said tubular housing and having a plurality of apertures for the inflow of fluids after the fluids have passed into the casing and through the at least one port in the tubular housing;

(d) a gear assembly coupled to said rotating rod assembly; and (e) a motor assembly connected to said tubular housing and coupled to said gear assembly.

2. The apparatus of claim 1 additionally comprising a generally hollow mechanical lock assembly disposed in said tubular housing and having a latching member; a pump seating nipple secured to said tubular housing; and a pump shoulder member supported by said pump seating nipple.

3. The apparatus of claim 2 wherein said rotating rod assembly additionally comprises at least one bushing member secured to said rotating rod assembly housing and engaged to said tubular housing to prevent undesirable particulates from entering into contact with the rotating rod member; said rotating rod assembly housing having a structure defining at least one bearing aperture; and at least one rod assembly bearing disposed in said at least one bearing aperture to keep said traveling barrel from rotating; said rotating rod member having a structure defining a plurality of helix tracks; a plurality of traveling barrel bearings engaged to said traveling barrel and disposed in said plurality of helix tracks; and a tapered bushing member connected to said rotating rod member.

4. The apparatus of claim 1 wherein said motor assembly comprises a motor housing; a stator secured to said motor housing and electrically engaged to an electrical conduit that extends up the well hole outside of said tubular housing; a rotor rotatably disposed within said stator; and a shaft connected to said rotor such as to rotate therewith; and a support bearing engaged to said motor housing and supporting said shaft.

5. The apparatus of claim 4 wherein said motor assembly comprises a motor housing; a stator secured to said motor housing and electrically engaged to an electrical conduit that extends up the well hole outside of said tubular housing; a rotor rotatably disposed within said stator; and a shaft connected to said rotor such as to rotate therewith; and a support bearing engaged to said motor housing and supporting said shaft.

6. The apparatus of claim 2 wherein said motor assembly comprises a motor housing; a stator secured to said motor housing and electrically engaged to an electrical conduit that extends up the well hole outside of said tubular housing; a rotor rotatably disposed within said stator; and a shaft connected to said rotor such as to rotate therewith; and a support bearing engaged to said motor housing and supporting said shaft.

7. The apparatus of claim 3 wherein said motor assembly comprises a motor housing; a stator secured to said motor housing and electrically engaged to an electrical conduit that extends up the well hole outside of said tubular housing; a rotor rotatably disposed within said stator; and a shaft connected to said rotor such as to rotate therewith; and a support bearing engaged to said motor housing and supporting said shaft.

8. The apparatus of claim 6 wherein said gear assembly comprises a tapered gear cone coupling member that is coupled to said rotating rod assembly; a gear coupling member coupled to said and tapered gear cone coupling member; and a tubular head member secured to said tubular housing.

9. The apparatus of claim 7 wherein said gear assembly comprises a tapered gear cone coupling member that is coupled to said rotating rod assembly; a gear coupling member coupled to said tapered gear cone coupling member; and a tubular head member secured to said tubular housing.

10. The apparatus of claim 1 wherein said gear assembly comprises a tapered gear cone coupling member that is coupled to said rotating rod assembly; a gear coupling member coupled to said tapered gear cone coupling member; and a tubular head member secured to said tubular housing.

11. The apparatus of claim 2 wherein said gear assembly comprises a tapered gear cone coupling member coupled to said rotating rod member; a gear coupling member coupled to said tapered gear cone coupling member and to said shaft; a tubular head member secured to said tubular housing and to said motor housing.

12. The apparatus of claim 3 wherein said tubular head member has a structure defining an aperture wherethrough fluid passes, said gear assembly additionally comprising a gear bushing supported by said tubular head member for engagedly supporting said shaft.

13. The apparatus of claim 4 additionally comprising a filter assembly coupled to said motor assembly.

14. The apparatus of claim 5 wherein said filter assembly comprises a filter housing coupled to said motor assembly; a filter base connected to said filter housing; a filter member disposed in said filter housing; and a heat exchanger member supported by said filter housing.

15. The apparatus of claim 9 additionally comprising a filter assembly coupled to said motor assembly.

16. The apparatus of claim 1 wherein said filter assembly comprises a filter housing coupled to said motor assembly; a filter base connected to said filter housing; a filter member disposed in said filter housing; and a heat exchanger member supported by said filter housing.

17. The apparatus of claim 2 additionally comprising a filter assembly coupled to said motor assembly.

18. The apparatus of claim 3 wherein said filter assembly comprises a filter housing coupled to said motor assembly; a filter base connected to said filter housing; a filter member disposed in said filter housing; and a heat exchanger member supported by said filter housing.

19. The apparatus of claim 4 additionally comprising a filter assembly coupled to said motor assembly.

20. The apparatus of claim 9 additionally comprising a filter assembly coupled to said motor assembly.

21. The apparatus of claim 10 additionally comprising a filter assembly coupled to said motor assembly.

22. The apparatus of claim 21 wherein said filter assembly comprises a filter housing coupled to said motor assembly; a filter base connected to said filter housing; a filter member disposed in said filter housing; and a heat exchanger member supported by said filter housing.

23. The apparatus of claim 1 additionally comprising a filter assembly coupled to said motor assembly.

24. The apparatus of claim 23 wherein said filter assembly comprises a filter housing coupled to said motor assembly; a filter base connected to said filter housing; a filter member disposed in said filter housing; and a heat exchanger member supported by said filter housing.

25. The apparatus of claim 3 wherein said filter base has a structure defining a vent opening which is capable of being plugged; and said filter assembly additionally comprising a plug pipe secured to said filter base.

26. An apparatus for pumping fluids from a subterranean formation comprising:

(a) a generally hollow lock body capable of being coupled to a tubular housing adapted to be suspended from its upper end in a well hole communicating with a subterranean formation, and having a structure defining at least one lock body port for the outflow of fluids from the subterranean formation;

(b) a pump barrel connected to the lock body and having a structure defining a plurality of openings for the inflow of fluids from the subterranean formation;

(c) a motor assembly;

(d) a rotating rod assembly having a generally hollow traveling barrel and disposed in the pump barrel;

(e) a pump assembly disposed in the pump barrel and coupled to the rotating rod assembly and including a generally hollow reciprocating pump plunger having at least one aperture for the inflow of fluids; and (f) a gear assembly coupled to the rotating rod assembly and to the motor assembly.

27. The apparatus of claim 4 additionally comprising a pump barrel standing valve connected to the pump barrel.

28. The apparatus of claim 27 wherein said pump assembly additionally comprises a plunger back pressure valve supported thereby.

29. A method for pumping well fluids from a well hole communicating with a subterranean formation comprising the steps of:

a) flowing well fluids through perforations in a casing disposed in a well hole communicating with a subterranean formation;

b) flowing subsequently well fluids through perforations in a tubular housing adapted to be suspended from its upper end in the well hole communicating with the perforations in the casing;

c) flowing subsequently the well fluids of step (b) through perforations in a pump barrel;

d) moving a generally hollow pump plunger having apertures in a downwardly direction causing the well fluids of step (c) to flow through the apertures and into the generally hollow pump plunger and through a pump back pressure valve; and e) moving the generally hollow pump plunger in an upwardly direction, causing the well fluids to flow through a generally hollow lock body and into and up the tubular housing.

30. The method of claim 29 additionally comprising flowing the well fluids through a standing valve before flowing the well fluids through the hollow lock body.

31. An apparatus for pumping fluids from a subterranean formation comprising:

(a) a tubular housing adapted to be suspended from its upper end in a well hole communicating with a subterranean formation; said tubular housing having a structure defining at least one port for the inflow of fluids from the subterranean formation;

(b) a pump assembly having a pump barrel disposed in said tubular housing and supported thereby, said pump assembly including a generally hollow reciprocating pump plunger having at least one aperture for the inflow of fluids and said pump barrel having a structure defining a plurality of openings for the inflow of fluids after said fluids pass through said at least one port of the tubular housing;

(c) a rotating rod assembly disposed in said pump barrel and comprising a rotating rod member, a traveling barrel member encapsulating at least a portion of the rotating rod member, and coupled to the generally hollow reciprocating pump plunger for moving the same;

(d) a gear assembly coupled to said rotating road assembly; and (e) a motor assembly connected to said tubular housing and coupled to said gear assembly, said motor assembly comprises a motor housing; a stator secured to said motor housing and electrically engaged to an electrical conduit that extends up the well hole outside of said tubular housing; a rotor rotatably disposed within said stator; and a shaft connected to said rotor such as to rotate therewith; and a support bearing engaged to said motor housing and supporting said shaft.

32. An apparatus for pumping fluids from a subterranean formation comprising:

(a) a tubular housing adapted to be suspended from its upper end in a well hole communicating with a subterranean formation; said tubular housing having a structure defining at least one port for the inflow of fluids from the subterranean formation;

(b) a pump assembly having a pump barrel disposed in said tubular housing and supported thereby, said pump assembly including a generally hollow reciprocating pump plunger having at least one aperture for the inflow of fluids and said pump barrel having a structure defining a plurality of openings for the inflow of fluids after said fluids pass through said at least one port of the tubular housing;

(c) a rotating rod assembly disposed in said pump barrel and comprising a rotating rod member, a traveling barrel member encapsulating at least a portion of the rotating rod member, and coupled to the generally hollow reciprocating pump plunger for moving the same;

(d) a gear assembly coupled to said rotating rod assembly, said gear assembly comprising a tapered gear cone coupling member that is coupled to said rotating rod assembly, a gear coupling member coupled to said tapered gear cone coupling member, and a tubular head member secured to said tubular housing; and (e) a motor assembly connected to said tubular housing and coupled to said gear assembly.

33. An apparatus for pumping fluids from a subterranean formation comprising:

(a) a tubular housing adapted to be suspended from its upper end in a well hole communicating with a subterranean formation; said tubular housing having a structure defining at least one port for the inflow of fluids from the subterranean formation;

(b) a pump assembly having a pump barrel disposed in said tubular housing and supported thereby, said pump assembly including a generally hollow reciprocating pump plunger having at least one aperture for the inflow of fluids and said numb barrel having a structure defining a plurality of openings for the inflow of fluids after said fluids pass through said at least one port of the tubular housing;

(c) a rotating rod assembly disposed in said pump barrel and comprising a rotating rod member, a traveling barrel member encapsulating at least a portion of the rotating rod member, and coupled to the generally hollow reciprocating pump plunger for moving the same;

(d) a gear assembly coupled to said rotating rod assembly, (e) a motor assembly connected to said tubular housing and coupled to said gear assembly; and (f) a filter assembly coupled to said motor assembly, said filter assembly comprises a filter housing coupled to said motor assembly, a filter base connected to said filter housing, a filter member disposed in said filter housing, and a heat exchanger member supported by said filter housing.

* * * * *